US006669390B1

(12) United States Patent
Porter et al.

(10) Patent No.: US 6,669,390 B1
(45) Date of Patent: Dec. 30, 2003

(54) BREATH FRESHENER WITH MOUTHWASH ATOMIZER

(75) Inventors: John J. Porter, 3 Gunview Farm Ct., Perry Hall, MD (US) 21128; Reginald Jarvis, Baltimore, MD (US); Michael Peters, Baltimore, MD (US)

(73) Assignee: John J. Porter, Perry Hall, MD (US)

( * ) Notice: Subject to any disclaimer, the term of this patent is extended or adjusted under 35 U.S.C. 154(b) by 0 days.

(21) Appl. No.: 10/301,785

(22) Filed: Nov. 22, 2002

(51) Int. Cl.[7] ..... A46B 11/02; A46B 5/02

(52) U.S. Cl. ..... 401/186; 401/195; 401/279; 401/286; 401/287

(58) Field of Search ..... 401/186, 183, 401/190, 195, 279, 286, 287

(56) References Cited

U.S. PATENT DOCUMENTS

| | | | | |
|---|---|---|---|---|
| 3,734,106 | A | * 5/1973 | Zimmerman | 401/183 X |
| 4,056,110 | A | 11/1977 | Landsman | |
| 4,132,359 | A | 1/1979 | Nozawa | |
| 4,141,471 | A | 2/1979 | Nozawa et al. | |
| 4,185,776 | A | 1/1980 | Nozawa | |
| 4,193,551 | A | 3/1980 | Saito et al. | |
| 4,228,931 | A | 10/1980 | Ruscitti et al. | |
| 4,274,173 | A | 6/1981 | Cohen | |
| 4,324,362 | A | 4/1982 | Stansbury, Jr. | |
| 4,434,916 | A | 3/1984 | Ruscitti et al. | |
| 4,467,822 | A | 8/1984 | Blackwell | |
| 4,482,263 | A | 11/1984 | Palamara | |
| 4,543,679 | A | 10/1985 | Rosofsky et al. | |
| D283,375 | S | 4/1986 | Rothrock | |
| D284,528 | S | 7/1986 | Jurado | |
| 4,693,622 | A | 9/1987 | Booth | |
| 4,783,871 | A | 11/1988 | Rich, Jr. | |
| 4,821,752 | A | 4/1989 | Widlak | |
| 4,827,550 | A | 5/1989 | Graham et al. | |
| 4,830,284 | A | 5/1989 | Maerte | |
| 4,842,168 | A | 6/1989 | Bougamont et al. | |
| 4,845,795 | A | 7/1989 | Crawford et al. | |
| 4,890,349 | A | 1/1990 | Nitzsche | |
| 4,890,732 | A | 1/1990 | Shackelford | |
| 4,938,392 | A | 7/1990 | Su | |
| 4,961,733 | A | 10/1990 | Joseph et al. | |
| 5,002,228 | A | 3/1991 | Su | |
| 5,016,781 | A | 5/1991 | Ten Wolde | |
| 5,020,694 | A | 6/1991 | Pettengill | |
| 5,088,145 | A | 2/1992 | Whitefield | |
| 5,104,004 | A | 4/1992 | von Schuckmann | |
| 5,186,627 | A | 2/1993 | Amit et al. | |
| D337,659 | S | 7/1993 | Lacy | |
| 5,224,234 | A | 7/1993 | Aesenault et al. | |
| 5,236,108 | A | 8/1993 | House | |
| 5,238,151 | A | 8/1993 | Weinstein | |
| 5,273,425 | A | 12/1993 | Hoagland | |
| 5,276,932 | A | 1/1994 | Byrd | |
| 5,289,949 | A | 3/1994 | Gentile | |
| 5,301,381 | A | 4/1994 | Klupt | |
| 5,304,009 | A | 4/1994 | Marshall | |
| 5,312,046 | A | 5/1994 | Knoch et al. | |
| 5,316,194 | A | 5/1994 | Sarraf | |
| 5,321,866 | A | 6/1994 | Klupt | |
| 5,323,933 | A | 6/1994 | Brakarz et al. | |
| 5,332,124 | A | 7/1994 | Cancro et al. | |
| 5,335,827 | A | 8/1994 | Gentile | |
| 5,339,476 | A | 8/1994 | Chang | |
| 5,348,194 | A | 9/1994 | Mascitelli et al. | |
| 5,353,460 | A | 10/1994 | Bauman | |
| 5,361,446 | A | 11/1994 | Rufo | |
| 5,383,242 | A | 1/1995 | Bigler et al. | |
| 5,394,584 | A | 3/1995 | Breitschmid | |

(List continued on next page.)

*Primary Examiner*—John Rivell
*Assistant Examiner*—Kathleen J. Prunner
(74) *Attorney, Agent, or Firm*—Kenyon & Kenyon

(57) ABSTRACT

A breath freshening apparatus includes a toothbrush and an atomizer. The toothbrush has bristles and a reservoir containing mouthwash. The atomizer is coupled to the reservoir and the bristles, where actuation of the atomizer results in a mist of the mouthwash being applied to the bristles.

10 Claims, 4 Drawing Sheets

U.S. PATENT DOCUMENTS 5,396,679 A 3/1995 Brown et al.
5,403,105 A 4/1995 Jameson
5,435,034 A 7/1995 Bigler et al.
5,438,726 A 8/1995 Leite
5,465,444 A 11/1995 Bigler et al.
5,465,445 A 11/1995 Yeh
5,472,665 A 12/1995 Rosofsky et al.
5,487,378 A 1/1996 Robertson et al.
D368,373 S 4/1996 Shimatsu et al.
5,526,960 A 6/1996 Breidenbach et al.
D371,242 S 7/1996 Shimatsu et al.
D373,529 S 9/1996 Zogg et al.
5,560,544 A 10/1996 Merritt et al.
D376,695 S 12/1996 Tveras
5,584,593 A 12/1996 Lafortune
5,586,694 A 12/1996 Breidenbach et al.
5,609,271 A 3/1997 Keller et al.
5,616,313 A 4/1997 Williams et al.
5,645,193 A 7/1997 Gentile et al.
5,657,930 A 8/1997 Battegazzore
5,665,332 A 9/1997 Mundschenk et al.
5,681,065 A 10/1997 Rua, Jr. et al.
5,690,913 A 11/1997 Hsu et al.
5,692,648 A 12/1997 Su
5,699,935 A 12/1997 Stahley
5,737,792 A 4/1998 Quigless
5,755,523 A 5/1998 Seydel
5,756,073 A 5/1998 Miller et al.
5,775,386 A 7/1998 Connan
5,782,384 A 7/1998 Mejia Mustafa et al.
D396,588 S 8/1998 Mack et al.
5,814,303 A 9/1998 Williams et al.
5,826,751 A 10/1998 Stahley et al.
5,837,167 A 11/1998 Lederer
5,842,487 A 12/1998 Ledet
5,842,604 A 12/1998 Stahley et al.
5,846,010 A 12/1998 Barbalich
5,849,241 A 12/1998 Connan
5,855,875 A 1/1999 Williams et al.
5,862,951 A 1/1999 Gruenbacher et al.
5,864,915 A 2/1999 Ra
5,871,124 A 2/1999 Wilkinson
5,873,494 A 2/1999 Dallas, Jr.
5,881,920 A 3/1999 Seager et al.
5,881,921 A 3/1999 Seager et al.
5,893,378 A 4/1999 Llerena
5,897,539 A 4/1999 Elliesen et al.
5,899,360 A 5/1999 Mack et al.
5,899,361 A 5/1999 Durliat et al.
5,902,568 A 5/1999 Ryles et al.
5,922,349 A 7/1999 Elliesen et al.
5,924,600 A 7/1999 Keller
5,927,889 A * 7/1999 La Flower ..... 401/268
5,939,052 A 8/1999 White, Jr. et al.
5,941,420 A 8/1999 Connan
5,947,335 A 9/1999 Milio et al.
5,950,873 A 9/1999 Williams et al.
5,954,231 A 9/1999 Durliat et al.
D415,413 S 10/1999 Cummings
D416,112 S 11/1999 Holliday et al.
5,988,444 A 11/1999 Williams et al.
6,036,057 A 3/2000 Poutiatine
6,036,391 A 3/2000 Holliday et al.
6,039,215 A 3/2000 Bell
6,039,216 A 3/2000 Cummings
6,056,469 A 5/2000 Algorri
D426,067 S 6/2000 De Melo
6,083,528 A 7/2000 Elliesen et al.
6,099,315 A 8/2000 Markowitz
6,120,754 A 9/2000 Lee et al.
6,145,153 A 11/2000 Weihrauch
6,145,513 A 11/2000 Chu et al.
6,161,729 A 12/2000 Gentile et al.
6,186,363 B1 2/2001 Keller et al.
6,214,321 B1 4/2001 Lee et al.
6,230,935 B1 5/2001 Mack et al.
6,233,773 B1 5/2001 Karge et al.
6,244,773 B1 * 6/2001 Geremia-Nargi ..... 401/202 X
6,331,088 B2 12/2001 Owens
6,349,442 B1 2/2002 Cohen et al.
6,357,449 B1 3/2002 Chu et al.
6,397,858 B1 6/2002 Cubillo-Buron
6,397,860 B1 6/2002 Hill, II

* cited by examiner

BREATH FRESHENER WITH MOUTHWASH ATOMIZER

BACKGROUND

1. Technical Field

Embodiments of the invention generally relate to breath freshening products. More particularly, embodiments relate to an apparatus that applies a mist of mouthwash to the bristles of a toothbrush in order to facilitate breath freshening.

2. Discussion

The desirability of fresh breath is well understood throughout modem society. Indeed, breath freshening products have been in existence for quite some time. Although many of these products have proven to be effective under certain circumstances, a number of difficulties remain.

One such difficulty relates to mobility. For example, the trend toward mobile phones, wireless networking and untethered computing typifies the need for a breath freshening technique that provides the maximum of freedom of movement. Unfortunately, traditional products such as mouthwash and toothbrushes typically require the user to spit (e.g., into a sink) the liquid remnants of the breath freshening products. Indeed, most toothbrushes require running water to wet the toothpaste and bristles before and after use. While more complex toothbrushing systems, such as the system described in U.S. Pat. No. 6,331,088 to Owens have internal pumping mechanisms to wet the bristles of the toothbrush, the user still needs a place to dispel the toothpaste, mouthwash and antibacterial rinse from his or her mouth. Such systems are therefore clearly designed for bathroom use. If a sink or other adequate receptacle is not available, the user may be forced to swallow the remnants, which can be harmful.

Other products such as mints require the user to swallow some or all of the dissolved mint, which may result in undesirable calorie intake and/or other dietary drawbacks. Even chewing gum has practical limitations due to the general societal disapproval of chewing in public. Mints and gum can also take a certain amount of time to take effect, where instantaneous results may be desired. In addition, conventional mints and gum simply cover up bad breath instead of eliminating the bacteria that causes the odor. As a result, these products are typically effective for only a short period of time. There is therefore a need for an instantaneously effective and long lasting breath freshening product that does not require running water or spitting, and eliminates the need to chew or swallow.

BRIEF DESCRIPTION OF THE DRAWINGS

The various advantages of embodiments of the present invention will become apparent to one skilled in the art by reading the following specification and appended claims, and by referencing the following drawings, in which:

DETAILED DESCRIPTION

Figure 1:
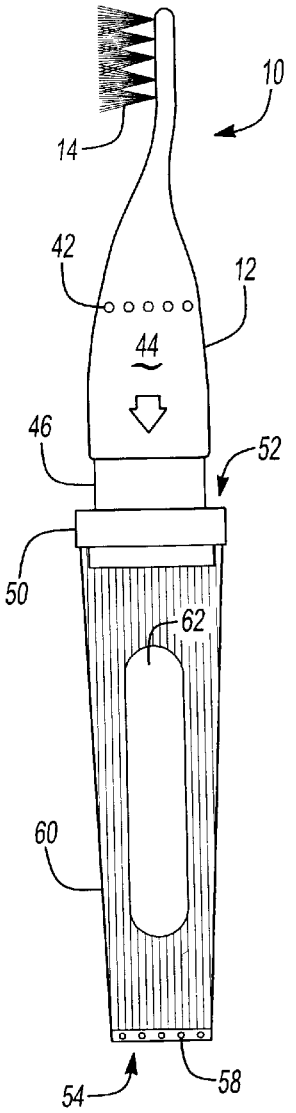
FIG. 1 is a side view of an example of a breath freshening apparatus according to one embodiment of the invention.
Figure 2:
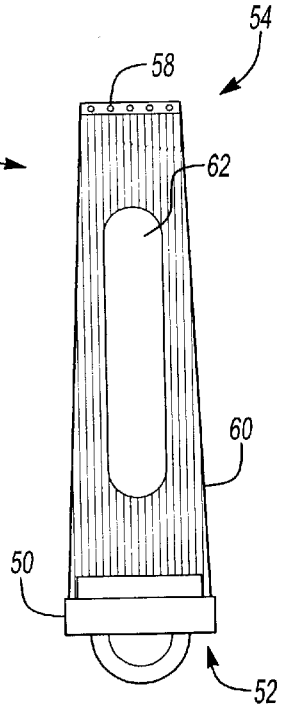
FIG. 2 is a side view of an example of the breath freshening apparatus shown in FIG. 1 with the cap coupled to the toothbrush over the bristles according to one embodiment of the invention.
Figure 3:
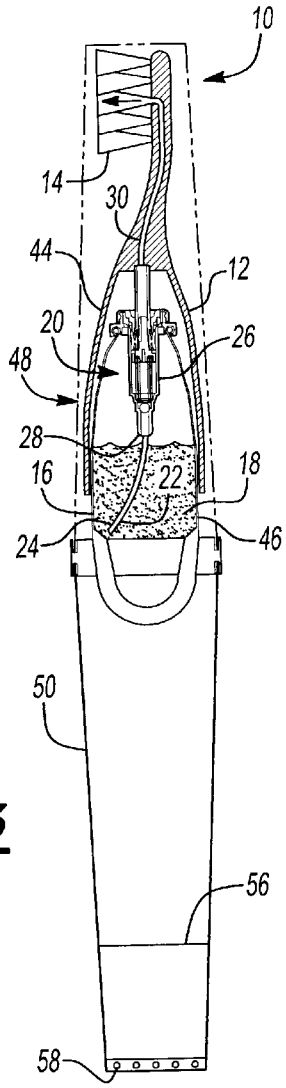
FIG. 3 is a sectional view of an example of the breath freshening apparatus shown in FIG. 1 according to one embodiment of the invention.

FIGS. 1–3 show a breath freshening apparatus 10 that is portable, compact and eliminates the need for rinsing, spitting, and digesting. Generally, the apparatus 10 includes a toothbrush 12 having bristles 14 and a reservoir 16 containing mouthwash 18. The mouthwash 18 can be any commercially available mouthwash. The apparatus 10 also has an atomizer 20 coupled to the reservoir 16 and the bristles 14. Actuation of the atomizer 20 results in a mist of the mouthwash 18 being applied to the bristles 14. By applying a mist of the mouthwash 18 to the bristles 14, as opposed to merely pumping the mouthwash 18 to the bristles 14 in liquid form, the apparatus 10 obviates the need of spitting or swallowing excess liquid. As a result, the apparatus 10 presents a completely unique approach to breath freshening that rivals the convenience of gum and mints without the shortcomings of these traditional products.

The illustrated atomizer 20 has an induction tube 22 having a first end 24 disposed within the reservoir 16. An atomizing pump 26 is coupled to a second end 28 of the induction tube 22. A delivery tube 30 is disposed between the atomizing pump 26 and the bristles 14. It should be noted that alternatively, the delivery tube 30 can be eliminated by merely using the internal walls of the passageway extending between the bristles 14 and the atomizing pump 26.

Figure 4A:
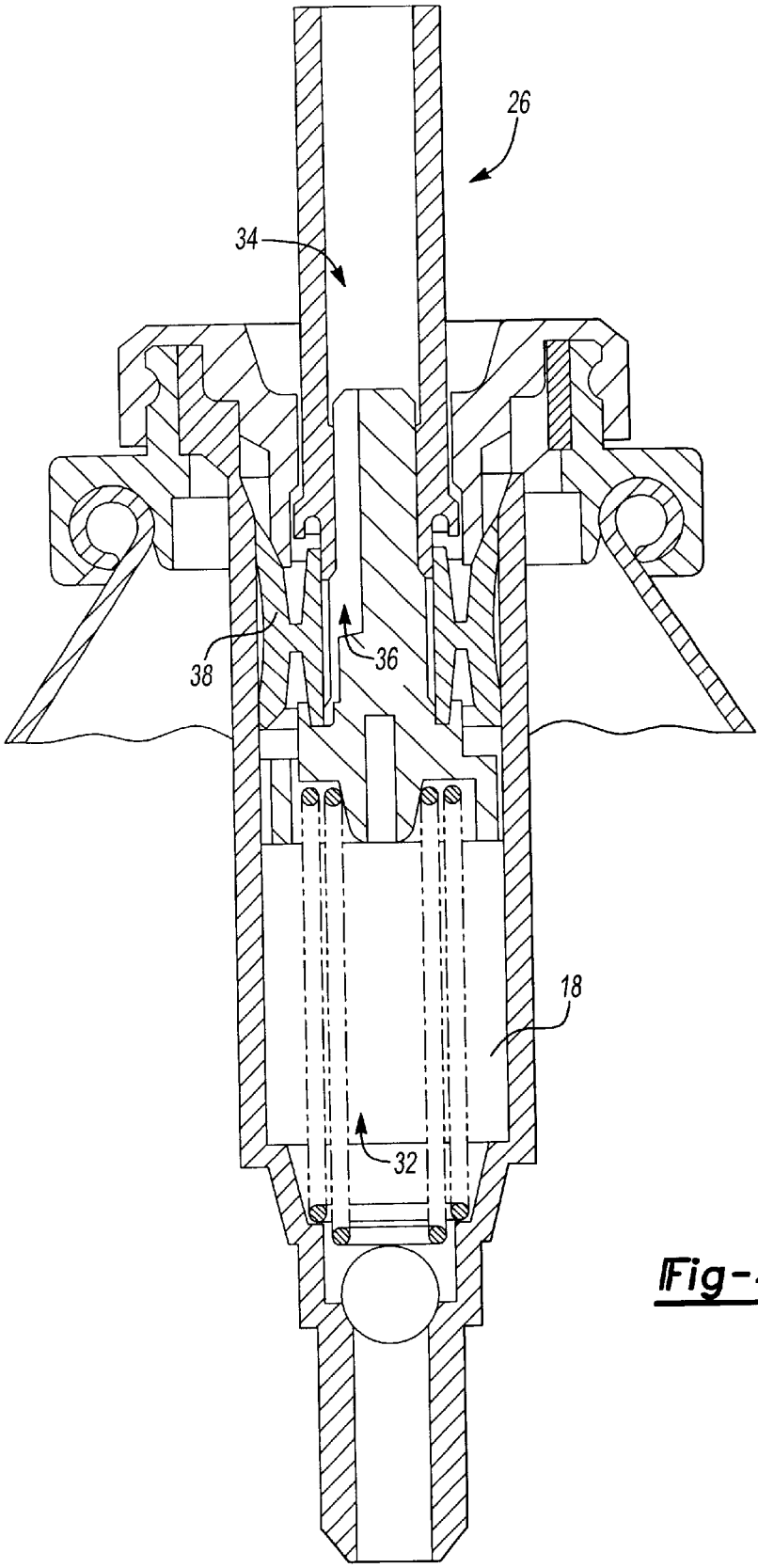
FIGS. 4A and 4B are enlarged views of an example of an atomizing pump according to one embodiment of the invention.
Figure 4B:
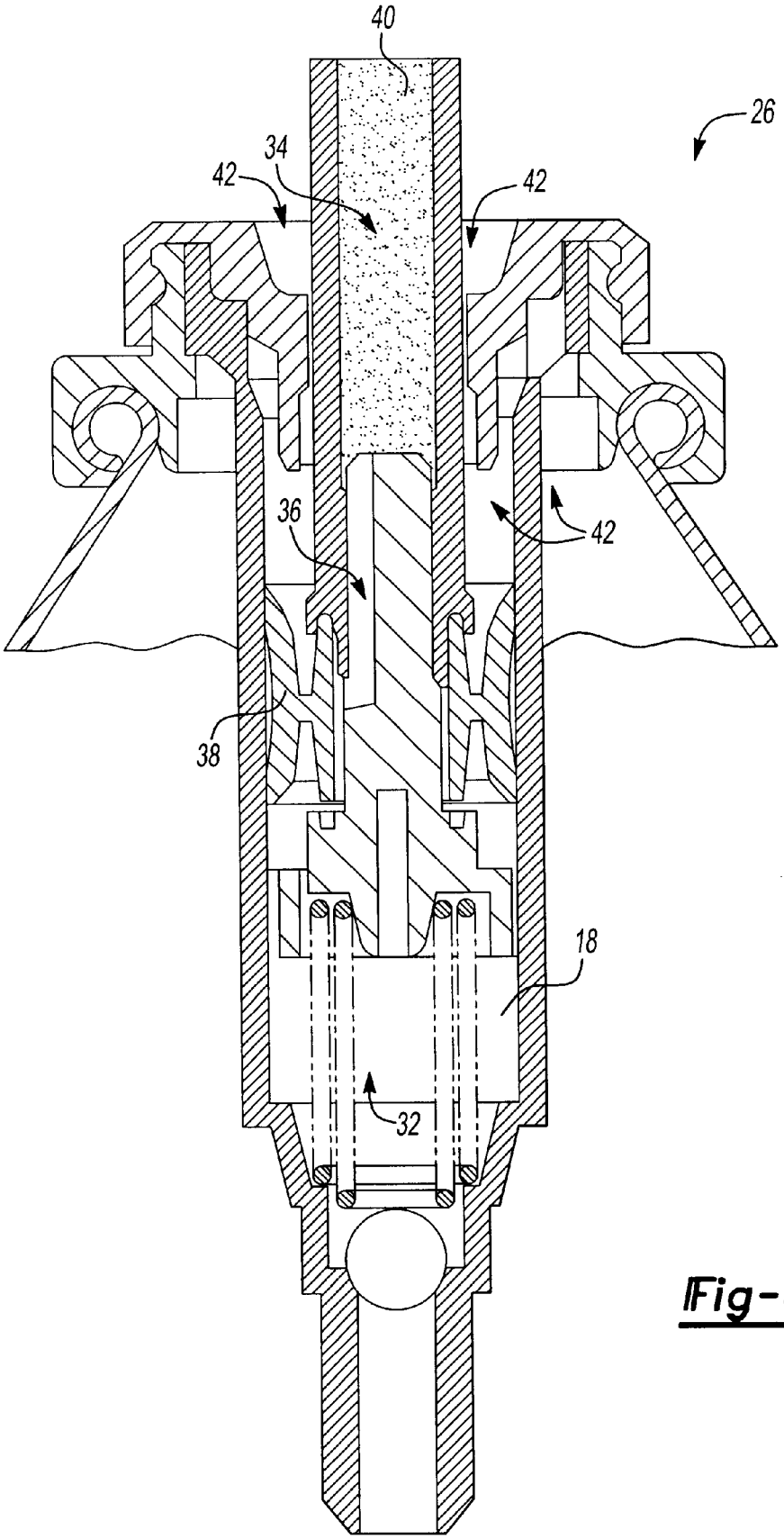

Turning now to FIGS. 4A and 4B, one approach to the atomizer pump 26 is shown in greater detail. Pump 26 has a structure similar to that of the pump described in U.S. Pat. No. 4,434,916 to Ruscitti, et al. Generally, FIG. 4A shows the atomizing pump 26 at rest (i.e., just before actuation), and FIG. 4B shows the atomizing pump 26 at its greatest stroke (i.e., just after actuation). The illustrated atomizer pump 26 has surfaces defining a metering chamber 32, a nozzle 34, and a pressurization passageway 36. The metering chamber 32 receives the mouthwash from the induction tube 22 (FIG. 3). It can be seen that during actuation (FIG. 4B), the pressurization passageway 36 extends between the metering chamber 32 and the nozzle 34, whereas during non-actuation (FIG. 4A), the pressurization passageway 36 is closed off by seal 38. During actuation, the pressurization passageway 36 receives the mouthwash 18 from the metering chamber 32 and injects airborne particles 40 of the mouthwash 18 into the nozzle 34. The pump 26 also has surfaces defining priming passageways 42, where the priming passageways 42 enable ambient air to enter the reservoir 16 (FIG. 3) during actuation of the pump 26.

While the illustrated atomizing pump 26 has a relatively sophisticated design with metering and priming functionality, the invention is not so limited. Indeed, any atomizer capable of breaking up a liquid into particles small enough to become airborne can be used. An example of alternative approach is shown in U.S. Pat. No. 5,348,194 to Mascitelli et al., incorporated herein by reference.

Figure 6:
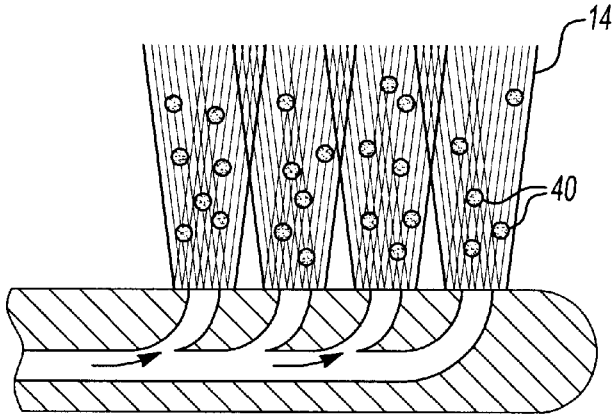
FIG. 6 is an enlarged view of an example of a set of bristle groupings or tufts having a mist of mouthwash applied according to one embodiment of the invention.

FIG. 6 shows an enlarged view of the bristles 14 forming a set of bristle groupings or tufts having particles 40 of the mouthwash applied in the form of a mist. The term "mist" is used herein to refer to particles of a liquid that are small enough to become airborne. The mist is applied into each of the plurality of bristle groupings or tufts through a plurality of passageways such that each passageway opens into an individual bristle grouping.

Returning now to FIGS. 1–3, it can be seen that the illustrated toothbrush 12 has a first housing 44 and a second housing 46 containing the reservoir 16. Longitudinal manipulation of the housings 44, 46 relative to one another results in actuation of the atomizer 20 because the nozzle 34 (FIGS. 4A & 4B) of atomizer 20 is fitted into an opening formed in the interior of the first housing 44. The housings 44, 46 also have locking surfaces 48 to selectively prevent actuation of the atomizer 20. Specifically, a protrusion on the external surface of the second housing 46 mates with an indentation on an internal surface of the first housing 44 to provide a "twist-and-lock" functionality. It can also be seen that priming passageways 42 are formed in the first housing 44 to further enable ambient air to enter the reservoir during the actuation of the atomizer pump.

The illustrated apparatus 10 also has a cap 50 having a generally inboard end 52 and an outboard end 54. One embodiment provides the cap 50 with a cleaning ridge 56. The cleaning ridge 56 removes excess mist from the bristles 14 if the cap is coupled to the toothbrush 12 over the bristles 14. The outboard end 54 also has surfaces defining evaporation apertures 58 to enable the excess mist to evaporate. The outer surface of the cap 50 also has a striated area 60 and a smooth area 62, where the smooth area 62 enables display of a printed message such as a logo. The striated area 60 facilitates gripping of the apparatus 10, while the smooth area 62 enhances the potential for advertising.

Figure 5:
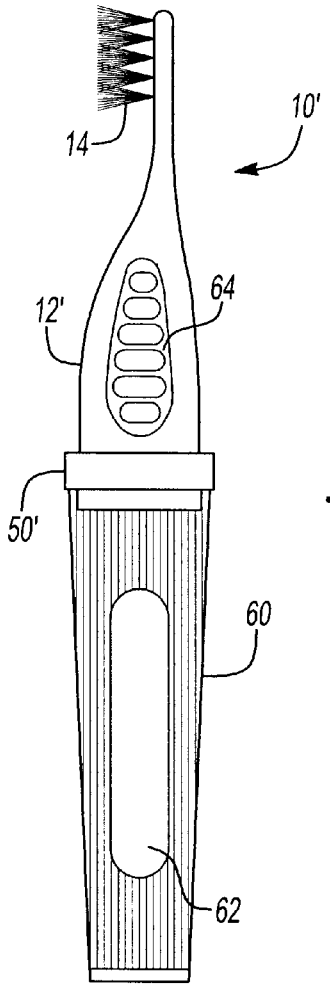
FIG. 5 is a side view of an example of a breath freshening apparatus according to an alternative embodiment of the invention.

FIG. 5 shows an alternative breath freshening apparatus 10' with a somewhat simplified design. Specifically, the toothbrush 12' has a modified reservoir, wherein the reservoir has resilient sidewalls 64. Laterally manipulating (e.g., "squeezing") the sidewalls 64 results in actuation of the atomizer. Since the modified apparatus 10' may be more prone to leakage, a modified cap 50' is provided, where the evaporation apertures are removed to provide a hermetically-sealed arrangement.

A user can therefore apply a mist of the mouthwash to the bristles 14 of a toothbrush, by actuating an atomizer that is built into the toothbrush, and quickly brush his or her teeth so that the mist is transferred to the interior of the mouth. The result is a feeling of "freshness" and reduction in odor similar to the results achievable through the use of gum and/or mints. In fact, the use of mouthwash eliminates the bacteria that causes the odor, and results in longer lasting effects. It should also be noted that the embodiments described herein do not require the user to chew gum or swallow the dissolved remnants of a mint. Furthermore, instantaneous results can be achieved without the need of prolonged use, as in the case of gum or mints.

Those skilled in the art can now appreciate from the foregoing description that the broad techniques of the embodiments of the present invention can be implemented in a variety of forms. Therefore, while the embodiments of this invention have been described in connection with particular examples thereof, the true scope of the embodiments of the invention should not be so limited since other modifications will become apparent to the skilled practitioner upon a study of the drawings, specification, and following claims.

What is claimed is:

1. A breath freshening apparatus comprising:

a toothbrush having a plurality of bristle groupings and a reservoir containing mouthwash; and an atomizer coupled to the reservoir and the plurality of bristle groupings, actuation of the atomizer to result in a mist of the mouthwash being applied into each of the plurality of bristle groupings through a plurality of passageways, each passageway opening into an individual bristle grouping.

2. The apparatus of claim 1, wherein the atomizer includes:

an induction tube having a first end disposed within the reservoir;

an atomizing pump coupled to a second end of the induction tube; and a delivery tube disposed between the atomizing pump and the plurality of bristles.

3. The apparatus of claim 2, wherein the atomizing pump includes surfaces defining a metering chamber, a nozzle and a pressurization passageway extending between the metering chamber and the nozzle, the metering chamber to receive the mouthwash from the induction tube, the pressurization passageway to receive the mouthwash from the metering chamber and to inject airborne particles of the mouthwash into the nozzle in response to actuation of the atomizer.

4. The apparatus of claim 2 wherein the toothbrush and the atomizer pump have surfaces defining one or more priming passageways, the priming passageways to enable ambient air to enter the reservoir during actuation of the atomizer pump.

5. The apparatus of claim 1 wherein the reservoir has resilient sidewalls, lateral manipulation of the sidewalls to result in actuation of the atomizer.

6. The apparatus of claim 1 wherein the toothbrush includes:

a first housing coupled to the bristles; and a second housing containing the reservoir, longitudinal manipulation of the housings relative to one another to result in actuation of the atomizer.

7. The apparatus of claim 6 wherein the housings have locking surfaces to selectively prevent actuation of the atomizer.

8. The apparatus of claim 1 further including a cap having an inboard end and an outboard end.

9. The apparatus of claim 8 wherein the cap further includes a cleaning ridge disposed within the cap, the cleaning ridge to remove excess mist from the bristles if the cap is coupled to the toothbrush over the bristle groupings, the outboard end having surfaces defining evaporation apertures to enable the excess mist to evaporate.

10. The apparatus of claim 8 wherein an outer surface of the cap has a striated area and a smooth area, the smooth area enabling display of a printed message.

* * * * *